US006358149B1

(12) United States Patent
Schneider et al.

(10) Patent No.: US 6,358,149 B1
(45) Date of Patent: Mar. 19, 2002

(54) DYNAMIC THRESHOLD FOR POOL-BASED BONUS PROMOTIONS IN ELECTRONIC GAMING SYSTEMS

(75) Inventors: Richard J. Schneider, Las Vegas, NV (US); Joseph G. Hart, Corvallis, OR (US); Joseph W. Canon, Albany, OR (US); Robert P. Bartholomew, Corvallis, OR (US); Michael B. Shelby, Corvallis, OR (US); Lawrence R. Pitman, Corvallis, OR (US)

(73) Assignee: Acres Gaming Incorporated, Las Vegas, NV (US)

( * ) Notice: Subject to any disclaimer, the term of this patent is extended or adjusted under 35 U.S.C. 154(b) by 0 days.

(21) Appl. No.: 09/245,048

(22) Filed: Feb. 4, 1999

Related U.S. Application Data

(60) Provisional application No. 60/099,921, filed on Sep. 11, 1998.

(51) Int. Cl.[7] ..... A63F 9/24

(52) U.S. Cl. ..... 463/27; 463/42

(58) Field of Search ..... 463/16, 17, 18, 463/19, 20, 22, 25, 26, 27, 28, 41, 42, 43

(56) References Cited

U.S. PATENT DOCUMENTS

| | | | |
|---|---|---|---|
| 3,598,964 A | 8/1971 | Dell et al. | 340/149 |
| 3,796,433 A | 3/1974 | Fraley et al. | 273/138 |
| 3,819,186 A | 6/1974 | Hinterstocker | 273/138 A |
| 4,072,930 A | 2/1978 | Lucero et al. | 340/152 T |
| 4,230,265 A | 10/1980 | Casaly | 235/455 |
| 4,258,838 A | 3/1981 | Rockola et al. | 194/1 R |
| 4,283,709 A | 8/1981 | Lucero et al. | 340/147 R |
| 4,335,809 A | 6/1982 | Wain | 194/1 R |

(List continued on next page.)

FOREIGN PATENT DOCUMENTS

| | | |
|---|---|---|
| AU | 589158 | 8/1986 |
| AU | 649009 | 8/1991 |
| AU | 647234 | 7/1992 |
| AU | 655801 | 9/1992 |
| AU | 633469 | 1/1993 |
| AU | A-70247/96 | 4/1997 |
| GB | 2151054 | 7/1985 |
| GB | 2211975 | 7/1989 |
| WO | WO 94/12256 | 6/1994 |
| WO | WO 95/22811 | 8/1995 |

*Primary Examiner*—Jessica J. Harrison
*Assistant Examiner*—Kim T. Nguyen
(74) *Attorney, Agent, or Firm*—Marger, Johnson & McCollom, P.c.

(57) ABSTRACT

A method and apparatus for awarding bonuses over a gaming network having a plurality of gaming machines, such as slot machines, interconnected by a network. Play is allowed to occur on a plurality of gaming machines as the bonus pool, common to the gaming machines over the network is incremented responsive to play on the plurality of gaming machines. The total number of eligible gaming machines is detected responsive to play on each of the plurality of gaming machines. A first threshold value is set in consideration of the total number of eligible gaming machines detected. A bonus period would be initiated when the bonus pool satisfies the first threshold value. Accordingly, the threshold necessary to start the bonus period would be low if few players are detected, and high if many players are detected. Bonus amounts are paid from the bonus pool to the eligible gaming machines after which time the bonus period would end. Alternately, bonuses would be paid responsive to detected triggering events during the bonus period, such as the occurrence of a special symbol on the slot machine reels. The bonus period would end when the bonus pool moves below a second threshold value after which time the bonus pool would be incremented for subsequently occurring bonus periods.

12 Claims, 8 Drawing Sheets

U.S. PATENT DOCUMENTS

| | | | | |
|---|---|---|---|---|
| 4,582,324 | A | | 4/1986 | Koza et al. ..... 273/138 A |
| 4,652,998 | A | | 3/1987 | Koza et al. ..... 364/412 |
| 4,679,143 | A | | 7/1987 | Hagiwara ..... 364/412 |
| 4,775,937 | A | | 10/1988 | Bell ..... 364/412 |
| 4,805,907 | A | | 2/1989 | Hagiwara ..... 273/138 A |
| 4,837,728 | A | | 6/1989 | Barrie et al. ..... 364/412 |
| 4,839,640 | A | | 6/1989 | Ozer et al. ..... 340/825.31 |
| 4,856,787 | A | | 8/1989 | Itkis ..... 273/237 |
| 4,964,638 | A | | 10/1990 | Ishida ..... 273/138 A |
| 4,991,848 | A | | 2/1991 | Greewood et al. ..... 273/143 R |
| 5,042,810 | A | | 8/1991 | Williams ..... 273/142 |
| 5,116,055 | A | | 5/1992 | Tracy ..... 273/138 A |
| 5,123,649 | A | | 6/1992 | Tiberio ..... 273/143 R |
| 5,217,224 | A | | 6/1993 | Sincock ..... 273/138 A |
| 5,224,706 | A | | 7/1993 | Bridgeman et al. ..... 273/85 CP |
| 5,249,800 | A | | 10/1993 | Hilgendorf et al. ..... 273/138 A |
| 5,257,179 | A | | 10/1993 | DeMar ..... 364/410 |
| 5,280,909 | A | | 1/1994 | Tracy ..... 273/138 A |
| 5,286,023 | A | | 2/1994 | Wood ..... 273/138 A |
| 5,332,219 | A | | 7/1994 | Marnell, II et al. ..... 273/138 A |
| 5,344,144 | A | | 9/1994 | Canon ..... 273/138 A |
| 5,345,379 | A | | 9/1994 | Brous et al. ..... 364/146 |
| 5,370,399 | A | | 12/1994 | Liverance ..... 273/434 |
| 5,401,024 | A | | 3/1995 | Simunek ..... 273/138 A |
| 5,429,361 | A | | 7/1995 | Raven et al. ..... 273/138 A |
| 5,470,079 | A | | 11/1995 | LeStrange et al. ..... 273/138 A |
| 5,472,194 | A | | 12/1995 | Breeding et al. ..... 273/138 A |
| 5,494,287 | A | | 2/1996 | Manx ..... 273/143 R |
| 5,507,489 | A | | 4/1996 | Reibel et al. ..... 273/138 A |
| 5,511,781 | A | | 4/1996 | Wood et al. ..... 273/85 CP |
| 5,536,016 | A | | 7/1996 | Thompson ..... 273/269 |
| 5,542,669 | A | | 8/1996 | Charron et al. ..... 463/13 |
| 5,547,192 | A | | 8/1996 | Ishibashi ..... 463/26 |
| 5,551,692 | A | | 9/1996 | Pettit et al. ..... 273/143 R |
| 5,580,309 | A | | 12/1996 | Piechowiak et al. ..... 463/16 |
| 5,603,659 | A | | 2/1997 | Okada ..... 463/25 |
| 5,611,730 | A | | 3/1997 | Weiss ..... 463/20 |
| 5,655,961 | A | | 8/1997 | Acres et al. ..... 463/27 |
| 5,707,286 | A | | 1/1998 | Carlson ..... 463/16 |
| 5,833,536 | A | | 11/1998 | Davids et al. ..... 463/11 |
| 5,833,538 | A | | 11/1998 | Weiss ..... 463/21 |
| 5,836,817 | A | * | 11/1998 | Acres et al. ..... 463/26 |
| 6,110,043 | A | * | 8/2000 | Olsen ..... 463/27 |

* cited by examiner

| | | | 1ST COIN | 2ND COIN | 3RD COIN |
|---|---|---|---|---|---|
| | | | 2000 | 4000 | 10000 |
| 7 | 7 | 7 | 400 | 800 | 1200 |
| 7 | 7 | 7 | 200 | 400 | 600 |
| 7 | 7 | 7 | 150 | 300 | 450 |
| 7 | 7 | 7 | 100 | 200 | 300 |
| ANY 7 | ANY 7 | ANY 7 | 50 | 100 | 150 |
| | BAR BAR | | 50 | 100 | 150 |
| | | | 40 | 80 | 150 |
| BAR BAR | BAR BAR | BAR BAR | 25 | 50 | 75 |
| ANY RED | ANY WHITE | ANY BLUE | 20 | 40 | 60 |
| | | | 10 | 20 | 30 |
| ANY BAR | ANY BAR | ANY BAR | 5 | 10 | 15 |
| ANY | TWO | | 5 | 10 | 15 |
| ANY RED | ANY RED | ANY RED | 2 | 4 | 6 |
| ANY WHITE | ANY WHITE | ANY WHITE | 2 | 4 | 6 |
| ANY BLUE | ANY BLUE | ANY BLUE | 2 | 4 | 6 |
| ANY | ONE | | 2 | 4 | 6 |
| BLANK | BLANK | BLANK | 1 | 2 | 3 |

FIG.7

DYNAMIC THRESHOLD FOR POOL-BASED BONUS PROMOTIONS IN ELECTRONIC GAMING SYSTEMS

This application claims priority from U.S. Provisional Patent Application No. 60/099,921 filed Sep. 11, 1998.

BACKGROUND OF THE INVENTION

This invention relates generally to electronic gaming machines interconnected by a computer network and more particularly to a method and apparatus for dynamically adjusting bonusing thresholds to accommodate players on linked gaming machines during off-peak as well as peak playing periods.

Casinos typically include electronic gaming machines (EGMs) such as slot machines and video poker machines. These games are referred to herein as the "primary game" associated with the particular gaming machine. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

More recently, multiple gaming machines have been linked together into groups of machines that share the same bonus pool. The advantage of the progressive system is that the bonus pools from individual machines can be pooled to form larger awards, which in turn attract more players. When taken to the extreme, progressive bonuses can be pooled together not only from machines in different areas of the casino, but also from different casinos in different states. Recently developed bonusing systems are implemented using bonus servers distributed over a network, such as disclosed in co-pending application Ser. No. 08/843,411, filed Apr. 15, 1997 and assigned to the Assignee of the present application (the '411 application), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

In a typical bonusing system, bonus prizes are awarded on top of regular jackpot pay table prizes when a progressive bonus pool meets or exceeds a predetermined, first threshold value. Exceeding this threshold value starts a bonus period. A predefined percentage of coins wagered on the games are placed into a common bonus pool. The amount of the bonus pool is then continually compared to the first threshold value. This first threshold value is either fixed or is selected at random at the start of each pool accrual cycle. When the pool reaches the threshold value, the bonus period commences in which bonus prizes are awarded to all eligible games on the link, or alternately are awarded to some subset of eligible machines on the link, which meet some other criteria. Typically, eligibility implies that the machine has a person who is playing at some predefined minimum acceptable play rate—for instance three coins every thirty seconds. The awarded bonus prizes are then decremented from the bonus pool. When the bonus pool falls below a second (lower) threshold, the bonus period is stopped until the bonus pool again rises beyond the predetermined, first threshold value.

With this method of funding and awarding bonuses, the frequency of occurrence for the bonus award depends upon how many machines are being played, how fast the players are playing, and how many coins are being wagered on each game played. The greater the rate of play, the faster the pool rises. The faster rising pool means more frequent threshold crossings, and thus more frequently occurring bonus periods and award payments. Under most conditions, this is a good effect. As more people play, the pool rises faster and the bonus awards are paid more frequently.

A major drawback with previous progressive bonusing schemes such as the one described above is that a person playing at non-peak times may never get to see a bonus event. If there is only one person playing on a bonus link that includes one-hundred games, the linked bonus will occur one-hundred times less frequently than if all of the games are being played. Consequently, the lone individual has a much different play experience than the person playing at peak times who gets to see the linked bonus awards occurring frequently.

Accordingly, a need remains for an improved gaming system that dynamically adjusts its bonusing scheme to accommodate the appropriate number of players during off-peak and well as peak playing times.

SUMMARY OF THE INVENTION

It is, therefore, an object of the invention to adjust the threshold to initiate a bonus period depending upon the number of eligible gaming machines on a bank of machines coupled together over a network link.

The invention comprises a method and apparatus for awarding bonuses over a gaming network having a plurality of gaming machines interconnected by a network. Play is allowed to occur on a plurality of gaming machines as the bonus pool, common to the gaming machines over the network, is incremented responsive to play on the plurality of gaming machines. The total number of eligible gaming machines is detected responsive to play on each of the plurality of gaming machines. A first threshold value is set in consideration of the total number of eligible gaming machines detected. A bonus period would be initiated when the bonus pool satisfies the first threshold value. Accordingly, the threshold necessary to start the bonus period would be low if few players are detected, and high if many players are detected. Bonus amounts are paid from the bonus pool to the eligible gaming machines after which time the bonus period would end. Alternatively, bonuses would be paid responsive to detected triggering events, such as the occurrence of a special symbol on the slot machine reels during the bonus period. The bonus period would end when the bonus pool moves below a second threshold value after which time the bonus pool would be incremented for subsequently occurring bonus periods.

One advantage of the bonusing system above is that awards can be varied from machine to machine during the linked bonus period. Additionally, the bonusing system has a demonstrable effect on game payback percentage, regardless of the rate of play across the bank of games, to encourage play and increase enjoyment.

The foregoing and other objects, features and advantages of the invention will become more readily apparent from the following detailed description of a preferred embodiment of the invention that proceeds with reference to the accompanying drawings.

BRIEF DESCRIPTION OF THE DRAWINGS

FIG. 7 is an exemplary pay table for the gaming machine of FIG. 2.

DETAILED DESCRIPTION

Figure 1:
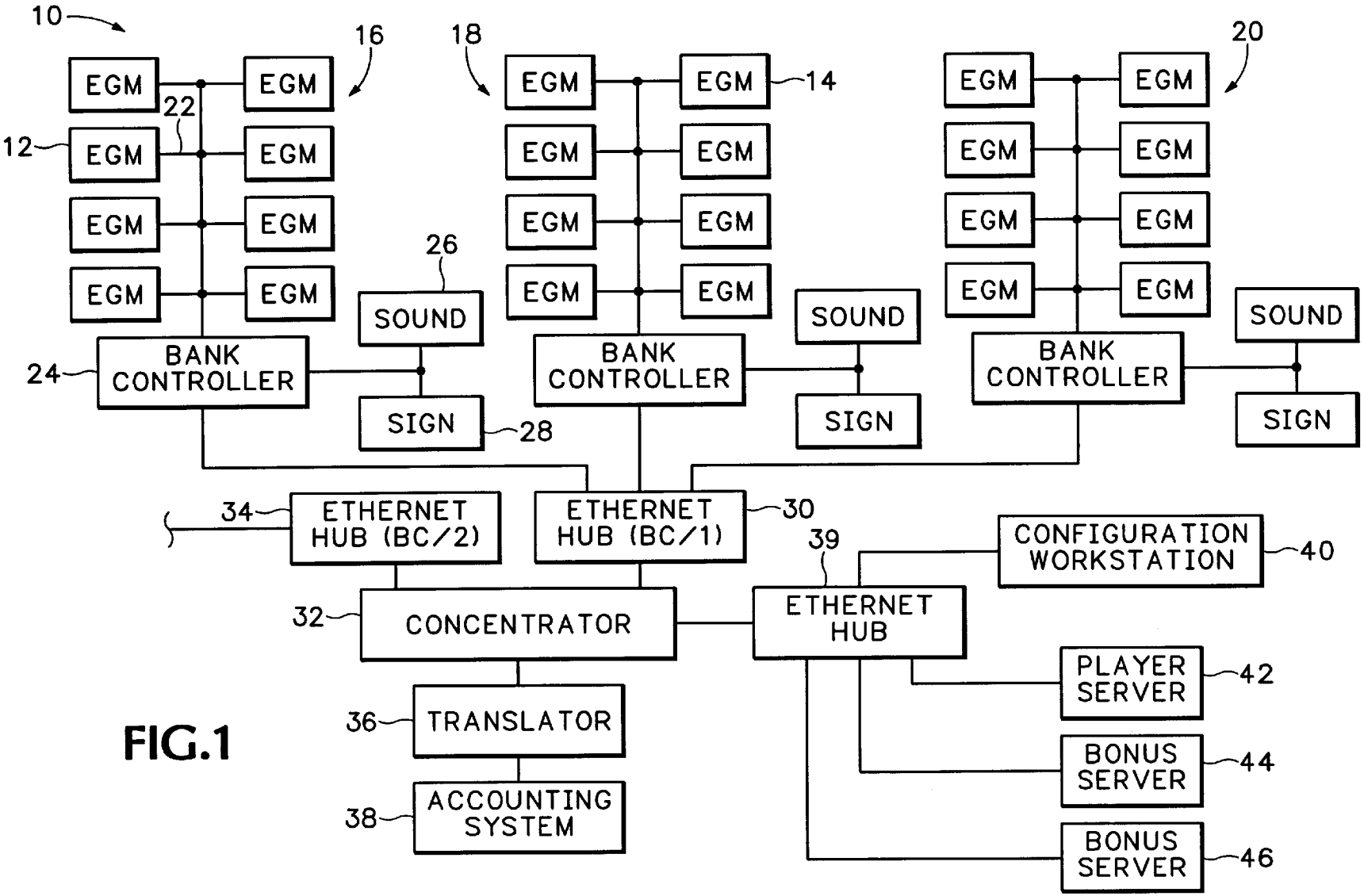
FIG. 1 is a schematic diagram of a plurality of electronic gaming machines interconnected by a computer network to a host computer in accordance with the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24.

In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, and 20 of EGMs to a concentrator 32. Another Ethernet hub 34 connects similar bank controllers (not shown); each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. In the present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network to establish bonus parameters discussed in more detail further below.

The player server 42 comprises a microcomputer that is used to control messages that appear on displays associated with each EGM. Player server 42 includes an NS486 processor manufactured by National Semiconductor Corp. of Santa Clara, Calif. and an Ethernet card.

Bonus servers 44, 46 each comprises a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in co-pending application Ser. No. 08/843,411, filed Apr. 15, 1997 and assigned to the Assignee of the present application (the '411 application), which is incorporated herein by reference for all purposes. This co-pending application also describes in more detail features of the network, like that shown in FIG. 1, which may be used to implement the present invention. The '882 patent also discloses bonuses that can be implemented by bonus servers 44, 46 and a network that could be used to implement the present invention.

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

Figure 2:
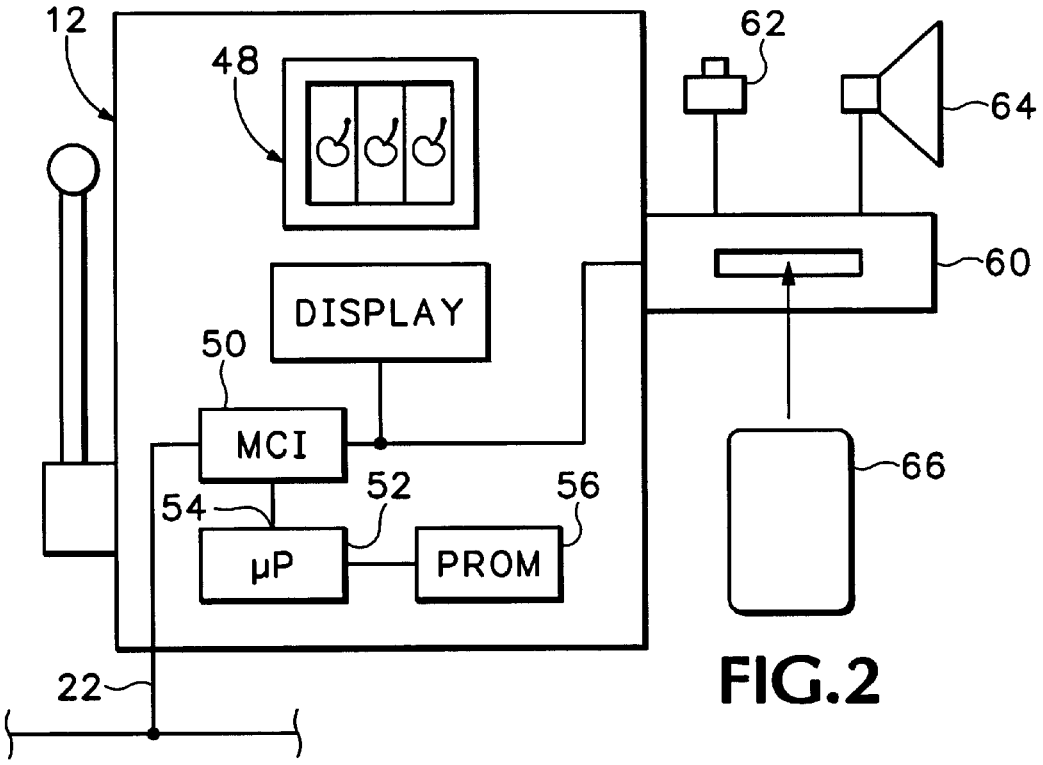
FIG. 2 is a schematic diagram of a slot-based electronic gaming machine and associated hardware implemented in accordance with the present invention.

FIG. 2 is a highly schematic representation of an electronic slot machine—typical of each of the machines in the network—which incorporates network communications hardware as described hereinafter. This hardware is described in the '882 patent, and is referred to therein as a data communications node. Preferably the network communications hardware is like that disclosed in the '411 application, namely a machine communication interface (MCI) 50.

Included in EGM 12 are three reels, indicated generally at 48. Each reel includes a plurality of different symbols thereon. The reels spin in response to a pull on handle 51 or actuation of a spin button 53 after a wager is made. FIG. 7 comprises the pay table for EGM 12. The first three columns depict different combinations of symbols on the reels. The fourth column of FIG. 7 indicates a jackpot amount won on a single coin wager when the combination of symbols in the first three columns appears after the reels spin. Columns five and six indicate the amount won when two and three coins, respectively, are wagered. Any combination of reels symbols other than those shown in FIG. 7 does not result in a jackpot payment to the player. However, it is possible that a special symbol (not shown on the pay table of FIG. 7) would trigger a bonus payment as described later herein.

MCI 50 facilitates communication between the network, via connection 22, and microprocessor 52, which controls the operation of EGM 12. This communication occurs via a serial port 54 on the microprocessor to which MCI 50 is connected. The MCI also facilitates communication between the network and a vacuum florescent display (VFD) 58, a card reader 60, a player—actuated push button 62, and a speaker 64. Microprocessor 52 can also be connected to a programmable read only memory (PROM) which controls the behavior or EGM 12 and which may or may not include the pay table of FIG. 7 whose purpose is described above.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of 100 appears on credit meter 70. To place a wager, the player depresses a bet button (not shown), which transfers a credit from the credit meter 70 to a bet meter 72. Each time the button is depressed, a single credit transfers to the bet meter up to a maximum bet that can be placed on a single play of the machine. In addition, a maximum-bet button (also not shown) may be provided to immediately transfer the maximum number of credits that can be wagered on a single play from the credit meter 70 to the bet meter 72.

When bet meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '882 patent and '411 application. Briefly summarizing such a system, a player registers with the casino prior to commencing gaming. The casino issues a unique player-tracking card to the player and opens a corresponding player account or record that is stored in a database of other player accounts stored on accounting system 38 (in FIG. 1). Prior to playing one of the EGMs in FIG. 1, the player inserts card 66 into reader 60 thus permitting accounting system 38 to track player activity, such as amounts wagered and won and rate of play.

To induce the player to use the card, the casino awards to each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

Award Funding

Figure 3:
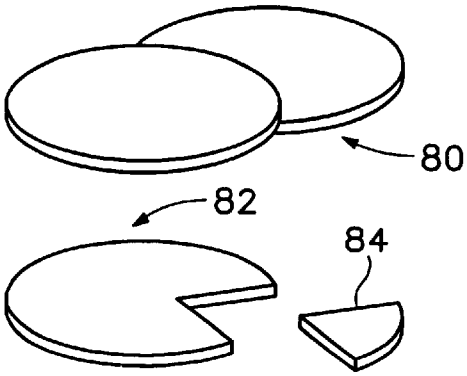
FIG. 3 is a schematic representation of how credits/coins played at the electronic gaming machines are used to fund various jackpot and bonus pools according to a preferred embodiment of the invention.

FIG. 3 illustrates a method for finding the jackpot and bonus payments for a bank of linked gaming machines according to a preferred embodiment of the invention. In the preferred funding method, also referred to herein as a "buy-a-pay" pay table, all coins 80 played less than the maximum amount are used to fund the multiplier section of the pay table. The pay table shown in FIG. 7, for instance, specifies that up to three coins can be played during each "pull". The third or maximum coin 82 is used to fund the linked bonus award. More specifically, the accrual rate of link bonus progressive pool is based on an operator-specified percentage 84 of the maximum coin as shown below in Table 1. In the preferred method, all non-maximum coins wagered, for instance coins 80, will not be accrued to a pool. However, it is understood that such coins can be used to fund the pool in an alternate embodiment of the invention. All linked bonus awards will be funded from a linked bonus pool administered by the bonus server 44 or 46.

TABLE 1

Funding of Bonus Progressive Pool

| Game Max Bet | Actual Bet | Accrual Amount |
|---|---|---|
| 3 | 3 | (1 coin) × (accrual rate) × (pennies/coin) |
| 3 | 2 | 0 |
| 2 | 2 | (1 coin) × (accrual rate) × (pennies/coin) |
| 2 | 1 | 0 |

For example, if the accrual rate of a slot machine that accepts quarters (25 pennies per coin) has been set at 60%, then the accrual amount that is added to the progressive bonus pool after each maximum bet is:

$$(1\text{ coin})\times(\text{accrual rate})\times(\text{pennies/coin}) \qquad \text{(Equation 1)}$$

or, $$1\times0.6\times25=\$0.15$$

This accrual amount is applied to the bonus pool according to the methods described below to reach the threshold amount so that a bonus period can begin.

Bonus Event Triggering Method

Figure 4:
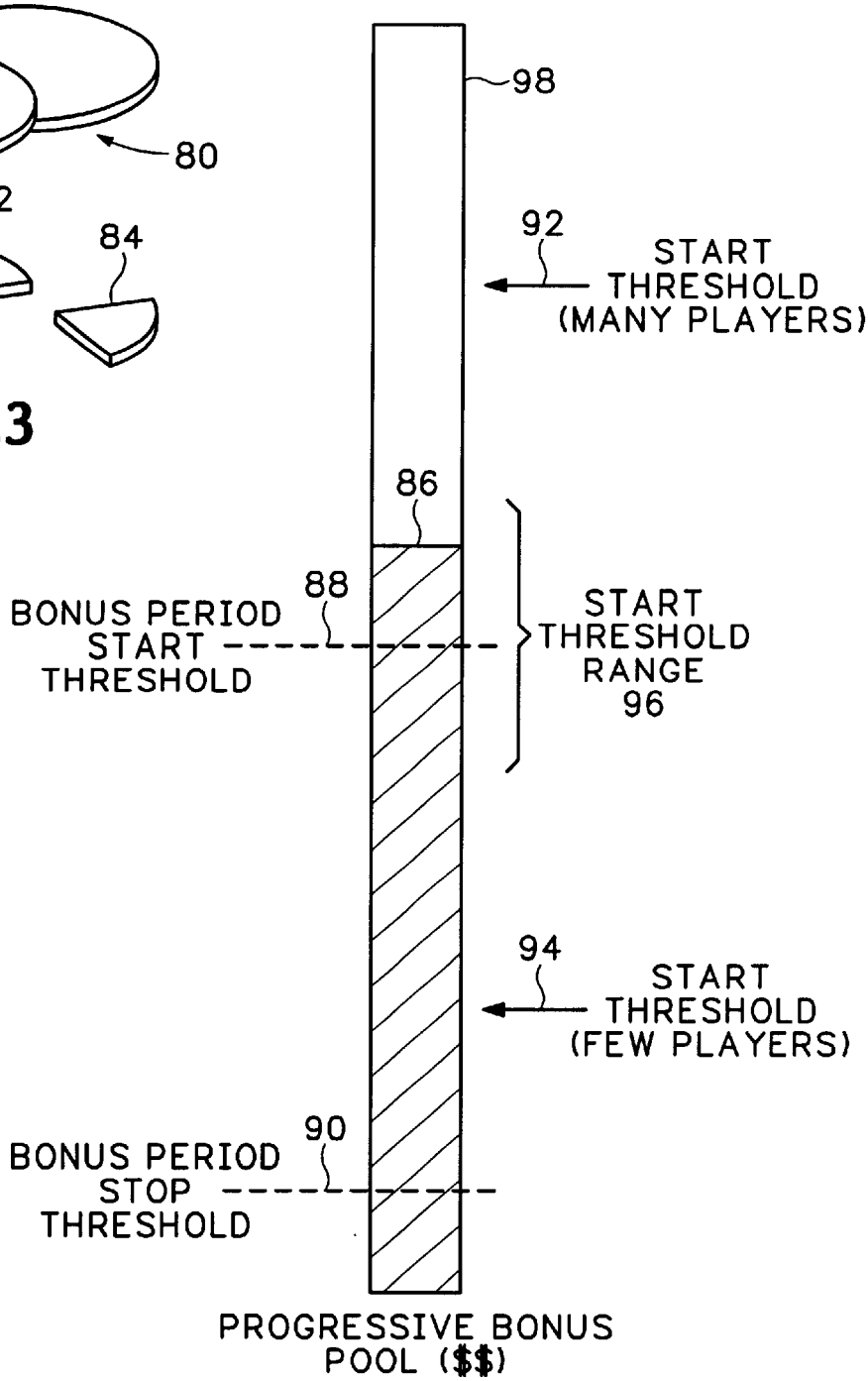
FIG. 4 is a schematic representation of a progressive bonus pool implemented according to the present invention to start a bonus period when the pool crosses a determined threshold.

FIG. 4 shows a bar graph illustrating the level to which the progressive bonus pool is funded by maximum bet play. The amount in the bonus pool is shown in cross-hatching at 86 as a percentage of a maximum amount that can be held in a bonus pool bank 98. The bonus pool bank, shown at 98, includes, in one embodiment of the invention, an upper threshold, such as the exemplary bonus period start threshold 88, and a lower threshold, such as the exemplary bonus period stop threshold 90. When the upper or first threshold 88 is met or exceeded, the bonus period commences. Threshold 88 is implemented dynamically according to the methods described below. For instance, the bonus pool threshold required to initiate the bonus period is adjusted depending upon the number of players currently playing on the bank of gaming machines 16 (FIG. 1). If a great many players are playing concurrently on the bank 16, then the start threshold 92 is set high. If the bank 16 of machines 12 is being played during off-peak playing times when few people are playing, then the threshold 94 is set low.

Figure 5:
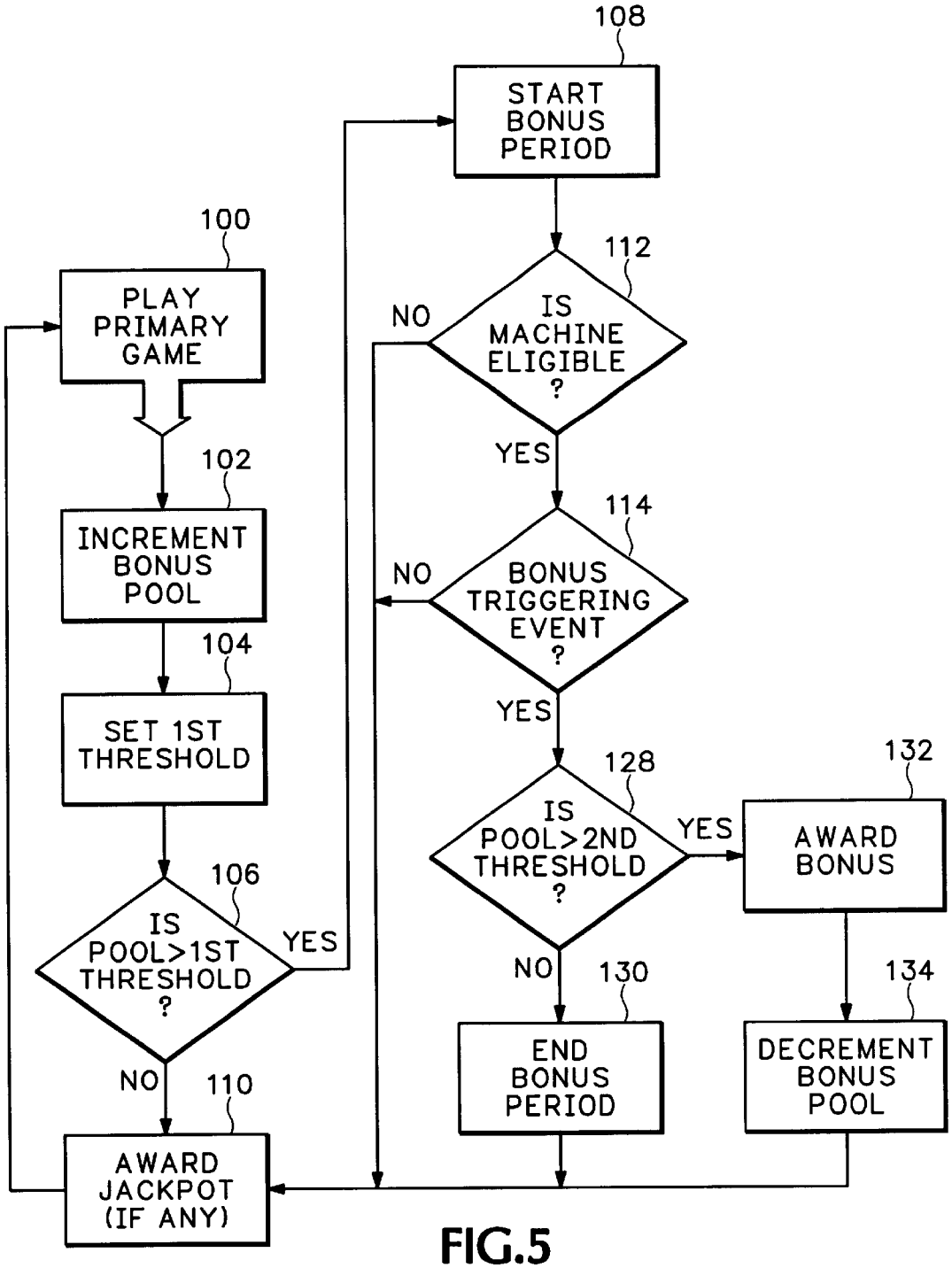
FIG. 5 is a flow diagram illustrating the method for implementing the present invention according to a preferred embodiment.

FIG. 5 shows a flow diagram of the bonusing system implemented according to a preferred embodiment of the present invention. Play is allowed to occur on the plurality of gaming machines constituting the bank of linked machines served by a bonus server in an initial step 100. The bonus pool is incremented in step 102 responsive to play on the plurality of gaming machines as by the methods described above. While play commences, an upper or first threshold value is set in step 104 in consideration of the number of machines currently being played on the link. The preferred method for setting the first threshold level is described in more detail below with reference to FIG. 6.

Figure 9:
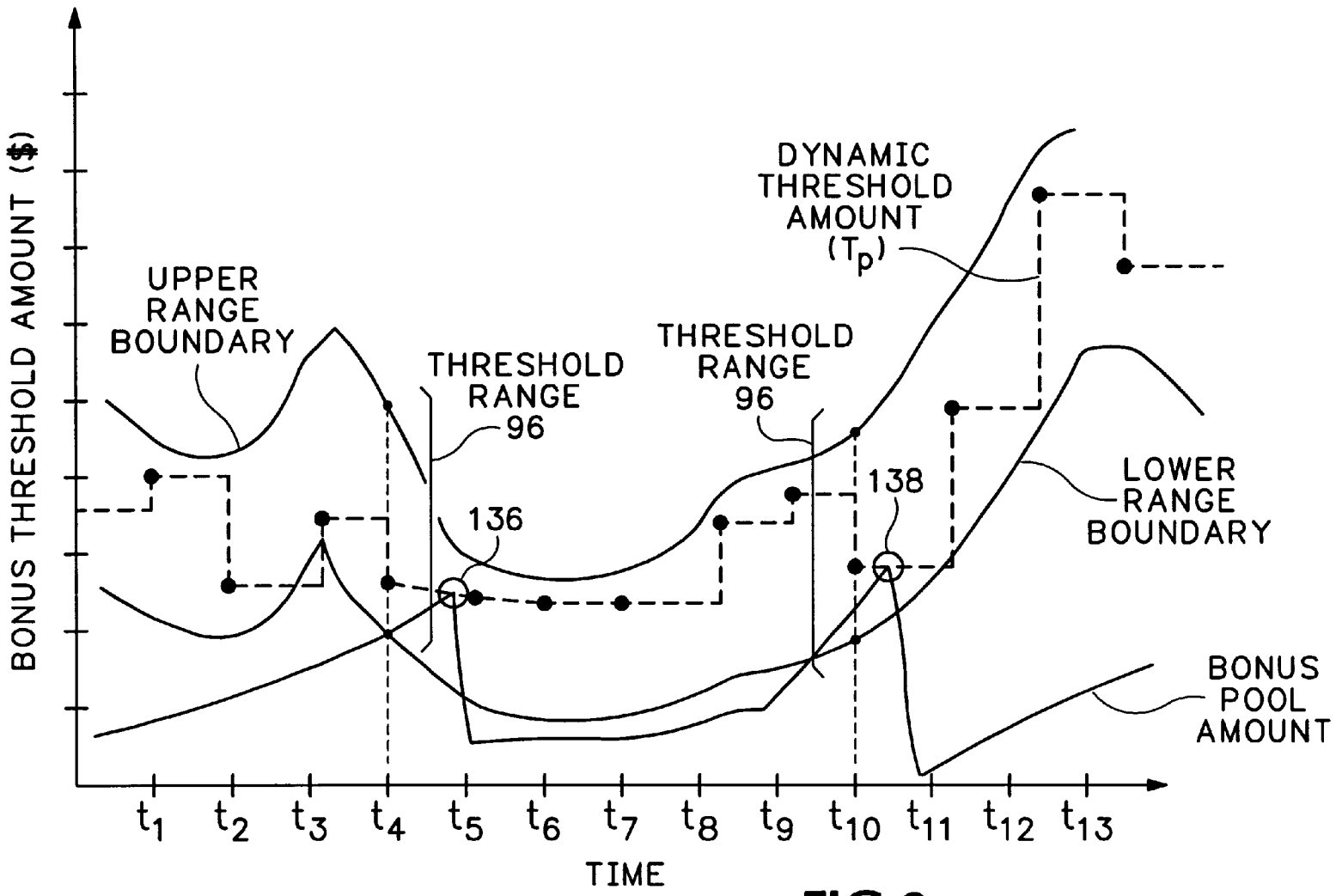
FIG. 9 is a graph showing how the threshold value changes with respect to the number of eligible players detected in the graph of FIG. 8.

Once the threshold level is set, the bonus server keeping track of the total amount in the bonus pool is queried in step 106 to determine whether a bonus period is to be initiated. If the total amount in the bonus pool satisfies the first threshold value, then the bonus period is initiated (step 108). If the bonus pool does not satisfy the threshold, then any jackpot award dictated by the pay table is awarded in step 110 and play continues in step 100 as before. In FIG. 9, for instance, the bonus pool amount (shown in dashed-dot line) slowly increases with play until it crosses the determined bonus threshold (dashed line) at time 136 (after which the pool is decremented by payouts of bonus awards) and later at time 138.

Eligibility

During any bonus period, the eligibility of the gaming machine is determined (step 112). In the preferred method, maximum coins must be played for a player to remain eligible. A player will become eligible immediately after the completion of a game played with maximum coins wagered.

Under the preferred method for determining eligibility, a player will lose eligibility if either of the two following conditions occur:

1. A game is played without a maximum coin wager, or
2. XX seconds has elapsed since the last maximum coin wager was made, where XX is an operator specified parameter The system should be configured to prevent conditions where a player could unduly prolong eligibility without continuing to make maximum coin wagers. For example, a player's machine would be considered ineligible for the bonus award if the maximum credits are paid but the player delays pressing the spin button 53 (FIG. 2) until after a predetermined time period.

Players can also lose eligibility when the gaming machine goes into a tilt, hand pay or error condition that would preclude normal operation of the game. A gaming machine's current eligibility status will be displayed on a display at the machine such as on display 58 (FIG. 2). If a machine is ineligible, then play proceeds to step 110 and the awarding of any jackpot amount dictated by the pay table of the gaming machine (if any) and continued play of the primary game (step 100).

The following are examples of alternate criteria that could be used to establish eligibility. For instance, use of player-tracking cards within the casino can be encourage by granting eligibility to those players using their card in the machine's card reader 60 (FIG. 2). Similarly, a player with card inserted can be made eligible based upon how much money he has played in the casino, how often he visits the casino, how much money he has lost at the casino, what tour group he is associated with, etc. Other examples of criteria used to establish eligibility include: player is playing any coin amount including non-maximum coin wagers, player is playing at a specified rate of play, player has won or lost a certain amount of money over a specified time period, person has hit a certain pre-qualifying base game outcome in the last X game rounds or in the last Y minutes, or a player can "buy" his eligibility for a certain money amount. These criteria are only intended to be exemplary as those that can be considered to implement the invention and are not intended to limit the application of the invention to others that can be envisioned.

Bonus Event Triggering Method

The linked bonus period can be triggered when a special symbol on the reels 48 (FIG. 2) is obtained after the linked bonus pool has reached the upper or first threshold value. This is referred to as the bonus-triggering event (step 114). Alternatively, the triggering event could occur simply upon the crossing of the first (upper) threshold value or the first maximum bet win that occurs after the bonus pool exceeds the upper threshold amount. Other alternate triggering criteria can be used to initiate the bonus period, examples of which being: first losing round on an eligible machine, first winning round on an eligible machine, first N consecutive winning or losing rounds, first machine to hit a specific base game outcome, or the first machine to hit one of a subset of predefined triggering outcomes.

The upper threshold is implemented according to a preferred embodiment of the invention so that it is dynamically adjusted based upon the number of eligible players on the link. The threshold value can also be based upon a random selection of possible threshold values between a user-specified range, such as shown by the range 96 shown in FIG. 4.

The dynamic pool threshold is preferably calculated as follows:

$$T_p = N_g * T_g \qquad \text{(Equation 2)}$$

where, $T_p$=Dynamic Pool Threshold.

$N_g$=Number of eligible gaming machines currently on the link.

$T_g$=Per Game Threshold where $T_g$ is a randomly selected value picked from an operator specified range such that: $T_{gmax} \geqq T_g \geqq T_{gmin}$ The operator will specify $T_{gmin}$ and $T_{gmax}$. The bonus server will select $T_g$ at the start of each linked bonus cycle. The random selection process can be such that all integer values between $T_{gmin}$ and $T_{gmax}$, inclusive will have an equal probability of being selected.

Unlike previous pool based bonus server applications, the operator specifies at the configuration workstation 20 (FIG. 1) the threshold amount in terms of the number of coins which must be accrued (on average) per eligible machine. This method essentially provides the operator with an easy means of selecting the typical number of bonuses awarded to each player in a bonus session.

The bonus amount can be randomly varied according to a selected one of a plurality of preestablished bonus pay distribution tables stored at the configuration workstation 40. Each pay distribution table includes the award amounts (in coins) and the relative weight or percentage chance of obtaining each bonus award. These amounts and weights are calculated to conform to desired pay rates for the machine to ensure adequate profit for the casino operating the gaming machines incorporating the present bonusing system. Pay Distributions can be downloaded to the configuration workstation via floppy disk or other communication medium. The pay distribution files include a checksum or CRC of the entire filespace to assure that all data has not been corrupted. The configuration workstation will check this CRC to confirm a non-corrupt file when the file is loaded into the configuration workstation.

One can calculate the average number of bonuses awarded by simply using a few operator-determined variables. A weighted average bonus award can be determined from the pay table. Dividing this number into $T_{gmin}$ and $T_{gmax}$ will give the operator a rough feel for the number of bonuses awarded in a typical linked bonus session. For example, assume the bonus award distribution provides for a weighted average award of 10 coins. Having $T_{gmin}$=30 and $T_{gmax}$=60 would provide for bonus sessions with each player getting anywhere from between about 3 to 6 bonuses. Slow players might get less. Fast players might get more.

In order to smooth dramatic swings in the dynamic pool that might result from groups of players starting or stopping play, the following preferred method can be used. The operator will be able to select the following two parameters: Threshold Update Period and Minimum Change in Eligible Games. The Threshold Update Period is the time (in seconds) between successive dynamic threshold adjustments. For example, if this parameter is set to 120, the bonus server will attempt to adjust the dynamic threshold every two minutes. The Minimum Change in Eligible Games parameter allows the dynamic threshold adjustment to ignore small changes in the number of eligible games on the link. For example, if this parameter is set to two, the bonus server will not adjust the dynamic threshold if the change in the number of eligible games is less than or equal to two.

Figure 6:
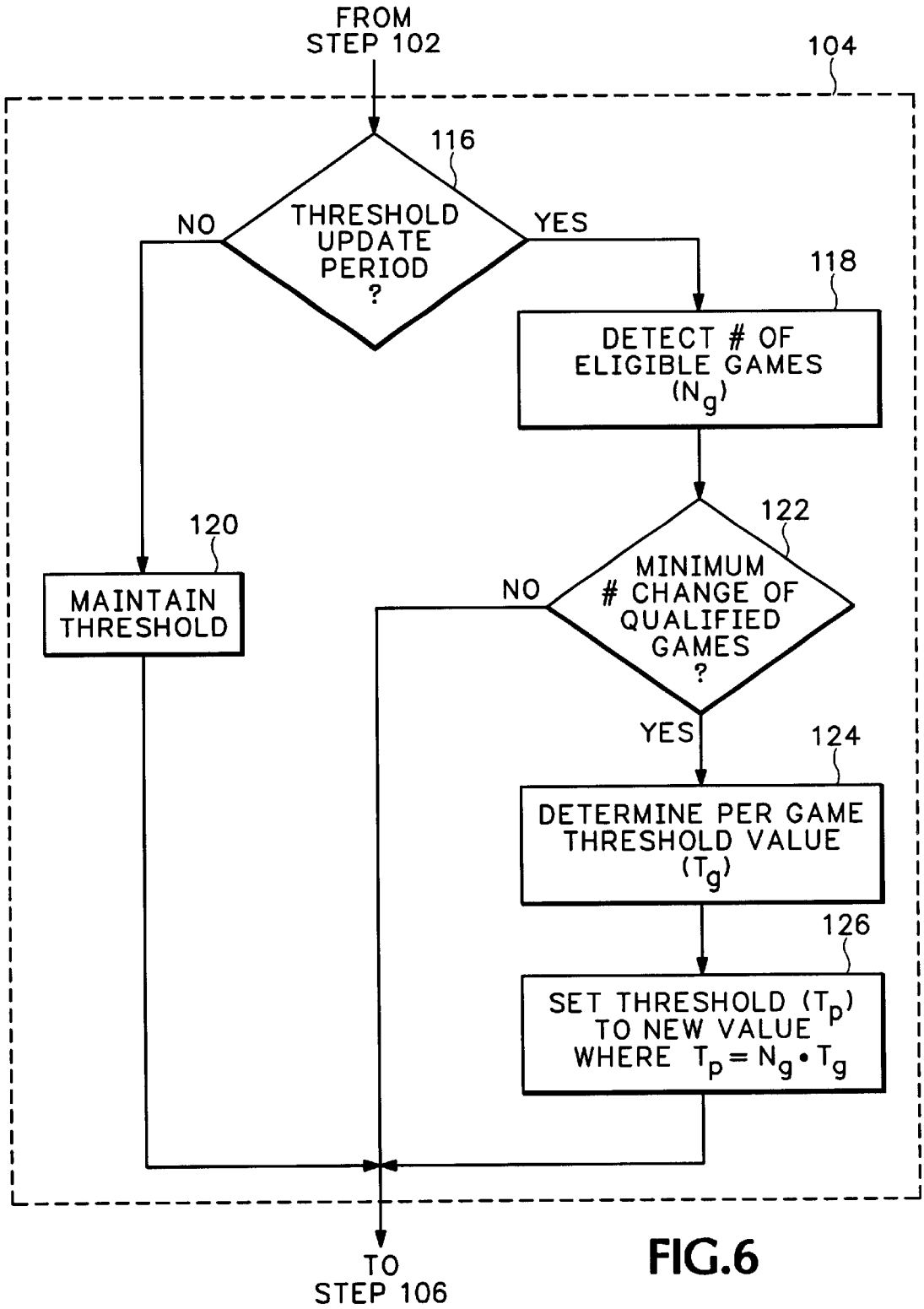
FIG. 6 is a flow diagram illustrating a method for dynamically setting a bonus period threshold according to a preferred embodiment of the invention.
Figure 8:
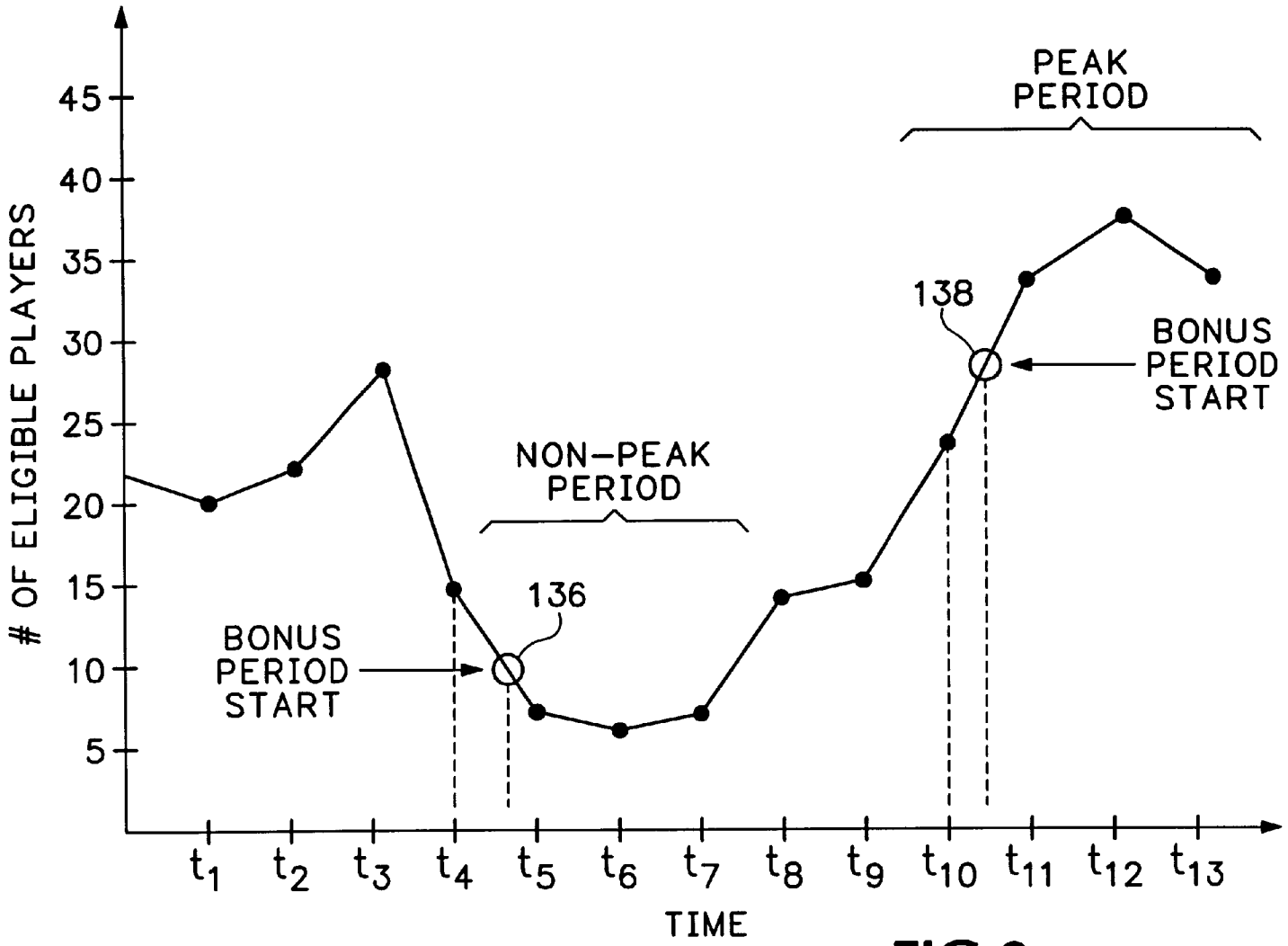
FIG. 8 is an exemplary graph showing the number of eligible players at each time $t_i$ (where i=0 to 13).

FIGS. 6, 8 and 9 illustrate in greater detail how the first threshold is set according to the preferred embodiment of the invention. If, in step 116, it is determined that the threshold is to be updated, then the process proceeds to determine the number of eligible games $N_g$ on the network link (step 118). If not within the threshold update period, then the previous threshold is maintained in step 120. Once the number of eligible games has been detected in step 118, then a query is made in step 122 to determine if the change in the number of detected eligible games from the previous threshold update period exceeds a predetermined amount. If the change exceeds the minimum amount, then the per eligible game threshold $T_g$ is determined in step 124 as described above. The new threshold value $T_p$ is then calculated and applied in step 126 according to equation 2 listed above.

Each successive threshold update period is shown in FIGS. 8 and 9 along the x-axis as $t_i$, where t=0 to 13. If there is no minimal change in eligible games, such as during the non-peak period of $t_5$ through $t_7$, then the dynamic threshold amount (shown by the dashed line) is maintained at its previous value (step 120, FIG. 6). If the minimum change is exceeded, such as during the peak period between times $t_9$ though $t_{13}$, then the dynamic threshold amount is randomly selected to be between a range of values between a lower and an upper boundary. This threshold amount is then active until the next threshold update period $t_{i+1}$ when the process begins again.

Ending the Linked Bonus Period

In a first embodiment, if a bonus-triggering event occurs, the amount in the bonus pool 86 is compared to the lower threshold in step 128, such as threshold value 90 in FIG. 4. If the amount has dropped below the second threshold value, then the bonus period is ended (step 130). If the amount is above the second threshold, such as the stop threshold value 90 in FIG. 4, then the bonus is awarded (step 132). During the link bonus period, all awards paid will be decremented from the pool (step 134). The pool will swing positive as funds are accrued, then fall to the second threshold value or, alternately, to zero or to a modest negative value as linked bonus awards are paid.

Some games will be in the middle of a bonus sequence when the message is received to end the bonus pool. These games will be allowed to complete the bonus sequence and the award will be paid. These late awards will inevitably cause the bonus pool to be negative. To assure adequate funding of the bonus pool, it will be incrementing from this negative value.

Any games abandoned while in the linked bonus mode will "time out" after a reasonable time has elapsed at the conclusion of a bonus period. The time out will cause the bonus to be paid and the machine to revert to the normal, non bonus-operating mode.

In another aspect of the invention, the anticipated number of bonuses awarded to each eligible machine is determined during the threshold update period ti. Between that period $t_i$ and the next $t_{i+1}$, more or less machines might become eligible. In FIG. 8, for instance, it can be seen that less machines are eligible for bonus at time 136 after time $t_4$ whereas more machines are eligible for bonus at time 138 after time $t_{10}$.

In the first instance, if it was determined at time $t_4$ that fifteen machines were eligible for a threshold bonus of $600 (where an average bonus is $10), then the bonus server would queue four bonuses in the MCI 50 of each eligible machine. Because only ten machines are eligible at time 136 when the bonus period begins, however, the bonus pool would more than likely not be exhausted by awarding the four bonuses to each of the ten eligible machines. Instead an average of $200 would be left in the bonus pool by the time the bonus period ends.

In the second instance, if it was determined at time $t_{10}$ that twenty-five machines were eligible for a threshold bonus of $750 (where the average bonus is $10), then the bonus server would queue three bonuses in the MCI 50 of each eligible machine. When the number of eligible machines rises to thirty at the start of the bonus period 138, three bonuses are still awarded per eligible machine. Accordingly, the bonus pool would average a minus $150 balance at the end of the bonus period. This negative amount serves as the baseline from which the bonus pool is incremented, thus causing the bonus pool to reach the next threshold level in more time than normal.

Alternate Bonus Payment Methods

Any number of methods for awarding bonus payments can be used in combination with the dynamic threshold of the present invention. Some of such methods would have bonus periods that last for a predetermined amount of time and thus do not rely on the methods for ending the bonus period discussed in the above section. The following alternate methods, in addition to the multiple bonus payments described above, are intended to be exemplary only and are not intended to limit the application of the invention.

In a first alternate method for awarding bonus payments during the bonus period, the bonus period consists of several trials of a bonus round with each trial providing a bonus amount. The bonus period could extend for a fixed number of trials for a fixed amount of time, or until a special trial outcome occurs which designates the end of the trial period.

In a second alternate method, all eligible machines would receive the same single lump sum bonus award. Alternately, each eligible machine could be given a different lump sum bonus award selected at random from a range of possible values. Eligible players could also be shown several possible bonus amounts. A final bonus prize would then be selected from all possible bonus amounts. Each eligible player could be shown separate possible bonus amounts, or there can be a single shared display that indicates the awards for all players.

In a third alternate method, all eligible players would be given the opportunity to select one of N hidden prizes. Once selected, the hidden bonus amount would be revealed. This can be done by either truly giving the player a selection of differing hidden amounts or by giving the player the illusion of choice where the hidden amounts are actually equal.

In a fourth alternate method, the bonus period would consist of a block of time during which all awards paid by the base game would be multiplied by some bonus value. In a fifth related method, a player could receive back as a refund all money lost in play during the bonus period. Players could also receive a multiple times their last wager.

Rapid Award Payment Details

In order to facilitate the expedient payment of varying awards to all eligible games, the first N (to be determined) bonus award amounts will be queued at the MCIs 50 of each of the eligible gaming machines on the link. The bonus server will then send a start linked bonus session broadcast that will signal the MCIs to start sending the pre-loaded messages to the game. Bonus payment confirmations will be sent back to the bonus server to allow real-time decrementing of the bonus pool. Additional pay commands will be sent to the MCIs as needed.

Having described and illustrated the principles of the invention in a preferred embodiment thereof, it should be apparent that the invention can be modified in arrangement and detail without departing from such principles. We claim all modifications and variation coming within the spirit and scope of the following claims.

We claim:

1. A method for awarding bonuses over a gaming network having a plurality of gaming machines interconnected by a network, the method comprising the steps of:

allowing play to occur on a plurality of gaming machines;

incrementing a bonus pool responsive to play on the plurality of gaming machines;

detecting a total number of eligible gaming machines responsive to play on each of the plurality of gaming machines;

setting a first threshold value in consideration of the total number of eligible gaming machines detected;

updating the total number of eligible gaming machines detected after the step of setting the first threshold value;

adjusting the first threshold value in consideration of the updated total number of eligible gaming machines detected;

initiating a bonus period when the bonus pool satisfies the adjusted first threshold value;

paying bonuses from the bonus pool to the eligible gaming machines during the bonus period; and ending the bonus period when the bonus pool satisfies a second threshold value.

2. The method of claim 1 wherein the steps of updating the total number of eligible gaming machines and adjusting the first threshold value are repeated after a predetermined amount of time to reflect a current number of eligible gaming machines capable of winning a bonus during any bonus period.

3. The method of claim 1 further including the steps of:

comparing the detected number of eligible gaming machines to the updated total number of eligible gaming machines to yield a change in eligible games parameter; and only adjusting the first threshold value if the eligible games parameter exceeds a predetermined amount so that the first threshold value does not change for minimal changes in the number of eligible gaming machines on the network.

4. The method of claim 1, wherein the first threshold value is calculated according to the following:

$$T_p = N_g \cdot T_g,$$

where $T_p$ is the first threshold value;

$N_g$ is the number of eligible gaming machines detected; and $T_g$ is a per gaming machine threshold value.

5. The method of claim 4 wherein $T_g$ is selected to be between a preselected minimum value $T_{gmin}$ and a preselected maximum value $T_{gmax}$.

6. A method for awarding bonuses over a gaming network having a plurality of gaming machines interconnected by a network, the method comprising the steps of:

Following play to occur on a plurality of gaming machines;

incrementing a bonus pool responsive to play on the plurality of gaming machines;

detecting a total number of eligible gaming machines responsive to play on each of the plurality of gaming machines;

setting a first threshold value in consideration of the total number of eligible gaming machines detected;

updating the total number of eligible gaming machines detected after the step of setting the first threshold value;

adjusting the first threshold value in consideration of the updated total number of eligible gaming machines detected:

initiating a bonus period when the bonus pool satisfies the adjusted first threshold value; and paying bonuses from the bonus pool to the eligible gaming machines during the bonus period.

7. The method of claim 6, further including the steps of:

decrementing the bonuses from the bonus pool; and ending the bonus period when the bonus pool moves below a second threshold value.

8. The method of claim 7 wherein the steps of updating the total number of eligible gaming machines and adjusting the first threshold value are repeated after a predetermined amount of time to reflect a current number of eligible gaming machines capable of winning a bonus during any bonus period.

9. The method of claim 7 further including the steps of:

comparing the detected number of eligible gaming machines to the updated total number of eligible gaming machines to yield a change in eligible games parameter; and only adjusting the first threshold value if the eligible games parameter exceeds a predetermined amount so that the first threshold value does not change for minimal changes in the number of eligible gaming machines on the network.

10. The method of claim 6 further including the step of paying bonuses from the bonus pool only to any of the updated total number of eligible gaming machines.

11. The method of claim 6, wherein the first threshold value is calculated according to the following:

$$T_p = N_g \cdot T_g,$$

where $T_p$ is the first threshold value;

$N_g$ is the number of eligible gaming machines detected; and $T_g$ is a per gaming machine threshold value.

12. The method of claim 11 wherein $T_g$ is selected to be between a preselected minimum value $T_{gmin}$ and a preselected maximum value $T_{gmax}$.

* * * * *

UNITED STATES PATENT AND TRADEMARK OFFICE

CERTIFICATE OF CORRECTION

PATENT NO. : 6,358,149 B1
DATED : March 19, 2002
INVENTOR(S) : Schneider et al.

It is certified that error appears in the above-identified patent and that said Letters Patent is hereby corrected as shown below:

Title page,
Item [57], ABSTRACT,
Line 6, “network is” should read -- network, is --.

Column 1,
Line 28, “read-on” should read -- read-only --.

Column 4,
Line 41, “read-on” should read -- read-only --.

Column 6,
Line 2, “finding” should read -- funding --.

Column 9,
Line 44, “though” should read -- through --.

Column 10,
Line 8, “ti” should read -- ti --.
Line 10, “136” should read -- 136 --.

Column 12,
Line 8, “Following play” should read -- Allowing play --.
Line 24, “detected:” should read -- detected; --.

Signed and Sealed this

Third Day of December, 2002

JAMES E. ROGAN
*Director of the United States Patent and Trademark Office*